US010577880B2

(12) United States Patent
Connell et al.

(10) Patent No.: US 10,577,880 B2
(45) Date of Patent: Mar. 3, 2020

(54) DEVICE AND SYSTEM FOR USE IN MONITORING CORING OPERATIONS

(71) Applicant: SPECIALISED OILFIELD SERVICES PTY LTD, West Perth (AU)

(72) Inventors: William Francis Connell, Chidlow (AU); Andrew Kenneth Thompson, Wembley Downs (AU)

( * ) Notice: Subject to any disclaimer, the term of this patent is extended or adjusted under 35 U.S.C. 154(b) by 316 days.

(21) Appl. No.: 15/517,164

(22) PCT Filed: Oct. 9, 2015

(86) PCT No.: PCT/AU2015/050616
§ 371 (c)(1),
(2) Date: Apr. 5, 2017

(87) PCT Pub. No.: WO2016/054698
PCT Pub. Date: Apr. 14, 2016

(65) Prior Publication Data

US 2017/0306713 A1 Oct. 26, 2017

(30) Foreign Application Priority Data

Oct. 10, 2014 (AU) ..... 2014904066

(51) Int. Cl.
*E21B 25/16* (2006.01)
*E21B 25/10* (2006.01)
(Continued)

(52) U.S. Cl.
CPC ..... *E21B 25/16* (2013.01); *E21B 25/10* (2013.01); *E21B 34/14* (2013.01); *E21B 47/12* (2013.01); *E21B 47/18* (2013.01); *E21B 49/02* (2013.01)

(58) Field of Classification Search
CPC ..... E21B 25/00; E21B 25/02; E21B 25/04; E21B 25/10; E21B 25/12; E21B 25/14; E21B 25/16; E21B 47/18
See application file for complete search history.

(56) References Cited

U.S. PATENT DOCUMENTS 1,720,700 A * 7/1929 Stone ..... E21B 25/12 175/234
2,789,790 A * 4/1957 Kirby, II ..... E21B 25/00 175/245

(Continued)

*Primary Examiner* — Blake E Michener
(74) *Attorney, Agent, or Firm* — Tope-McKay & Associates

(57) ABSTRACT

A system for monitoring coring operations has a sensor 80 for detecting one or more drilling parameters relating to a down-the-hole coring operation. An indicative signal from the sensor is communicated to a signal transmitter (30) for transmitting the indicative signal to the surface. The signal transmitter is located in or adjacent the coring assembly. The signal transmitter can be a mud pulser (30) housed above a core barrel (14). Communication of the indicative signal to the signal transmitter can be wireless, hard wired or conducted through the material of an outer barrel (12) of a drilling assembly. The core barrel can include a core limit recognition/detection device (34). An adapter/sub (90) incorporates a check valve (92) to relieve excess fluid pressure if there is sufficient hydraulic lock immediately above a core sample within the core barrel as the core sample enters the core barrel.

16 Claims, 5 Drawing Sheets

(51) Int. Cl.

| | |
|---|---|
| ***E21B 49/02*** | (2006.01) |
| ***E21B 34/14*** | (2006.01) |
| ***E21B 47/12*** | (2012.01) |
| ***E21B 47/18*** | (2012.01) |

(56) References Cited

U.S. PATENT DOCUMENTS

| | | | | | |
|---|---|---|---|---|---|
| 4,499,956 | A * | 2/1985 | Campbell | E21B 12/02 | 175/46 |
| 5,417,295 | A * | 5/1995 | Rao | E21B 25/00 | 175/40 |
| 5,568,838 | A * | 10/1996 | Struthers | E21B 10/02 | 175/246 |
| 6,006,844 | A * | 12/1999 | Van Puymbroeck | E21B 10/02 | 175/50 |
| 8,797,035 | B2 * | 8/2014 | Bittar | E21B 47/102 | 324/333 |
| 2005/0199393 | A1 * | 9/2005 | Goldberg | E21B 25/02 | 166/254.2 |
| 2008/0156537 | A1 * | 7/2008 | Stockton | E21B 25/00 | 175/58 |
| 2009/0159335 | A1 * | 6/2009 | Cravatte | E21B 25/00 | 175/40 |
| 2010/0000108 | A1 * | 1/2010 | Stockton | E21B 25/00 | 33/501.02 |
| 2012/0145457 | A1 * | 6/2012 | Stockton | E21B 25/00 | 175/44 |
| 2013/0199847 | A1 * | 8/2013 | Delmar | E21B 25/00 | 175/44 |

* cited by examiner

DEVICE AND SYSTEM FOR USE IN MONITORING CORING OPERATIONS

FIELD OF THE INVENTION

The present invention relates to a device and to a system for use in monitoring coring operations.

BACKGROUND TO THE INVENTION

Wells are generally drilled into the ground or ocean bed to recover natural deposits of oil and gas, as well as other desirable materials that are trapped in geological formations in the Earth's crust. Wells are typically drilled using a drill bit attached to the lower end of a "drill string".

Drilling fluid, or mud, is typically pumped down through the drill string to the drill bit. The drilling fluid lubricates and cools the drill bit, and carries drill cuttings from the borehole back to the surface.

In various oil and gas exploration operations, it is beneficial to have information about the subsurface formations that are penetrated by a borehole created by the passage of the drill bit. These measurements may be essential to predicting the production capacity and production lifetime of the subsurface formation.

Samples may need to be taken of the formation rock within the borehole. A coring tool is used to take a coring sample of the formation rock within the borehole.

A typical coring tool usually includes a hollow coring bit which comprises an annular cylindrical cutting surface. The coring tool penetrates into the formation such that a coring sample enters in a hollow cylindrical section. When the hollow center of the coring tool is filled with the core sample, the coring tool is brought to the earth's surface to retrieve the core sample for analysis.

The sample is analysed to assess, amongst other things, the reservoir storage capacity (porosity) and the permeability of the material that makes up the formation surrounding the borehole, such as the chemical and mineral composition of the fluids and mineral deposits contained in the pores of the formation. The information obtained from analysis of a core sample may be used to make exploitation decisions.

Downhole coring operations are generally axial coring or sidewall coring.

In axial coring, the coring tool is disposed at the end of a drill string within a borehole, in which the coring tool may be used to collect a coring sample at the bottom of the borehole.

In sidewall coring, the coring bit from the coring tool may extend radially from the coring tool, in which the coring tool may be used to collect a coring sample from a side wall of the borehole.

An axial coring tool is an assembly of an inner barrel, an outer barrel and an annular core bit located at a core engaging end of the coring tool. Located opposite to the core engaging end is an attachment end of the coring tool.

At the attachment end of the coring tool, the inner barrel and the outer barrel are connected to a top sub. The outer barrel is connected to the outer diameter (OD) of the top sub through a stabiliser. The inner barrel is connected to the inner diameter (ID) of the top sub through a swivel assembly.

The swivel assembly includes a bearing which restricts the inner barrel from rotating when the outer barrel is rotated by the rotating the drill pipe/string. The top sub is connected to the end of the drill string through a threaded connection.

Drilling fluid or mud is pumped down the center of the drill pipes which form a drill string. Upon reaching the coring assembly, the drilling fluid passes through the inner barrel as well as the annulus between the inner barrel and the outer barrel.

The drilling fluid exits through the inner barrel and the ports in the core bit. The drilling fluid is passed through the inner barrel to clear the inner barrel. The drilling fluid is passed through the annulus between the inner barrel and the outer barrel and out of the ports of the coring bit in order to cool and lubricate the coring bit.

The drilling fluid is returned to the surface from the annulus between the coring tool/drill pipes and the bore hole. The returning drilling fluid carries with it formation cuttings from the drilled hole.

Prior to commencing coring, in typical applications a steel ball is dropped down the drill pipe such that it rests in the swivel assembly in order to block flow of fluids to the inner barrel and divert flow to maintain the flow of fluid in the annulus between the inner barrel and the outer barrel. The steel ball is captured in a lower portion center pipe of the swivel assembly (lower portion being below the bearing of the swivel assembly), just above the inner barrel.

The steel ball when in position at the swivel assembly creates a one-way valve to allow fluid/pressure build-up within the inner core barrel during coring to be relieved, but to prevent fluid passing down into the inner core barrel during such coring.

The coring assembly is positioned at the surface of the formation from where the formation sample is to be obtained. The core bit is rotated by rotating the outer barrel which may be rotated by rotating drill pipe. The inner barrel is kept stationary. The rotation of the core bit and the weight on bit causes the coring tool to penetrate the formation. A core sample, positioned between in the annulus of the core bit, enters the inner barrel as the coring tool advances into the formation. Once the inner barrel is filled with core samples rotation of the core bit is ceased.

A core catcher, in some instances spring loaded, grips the core sample from below the inner barrel. As the coring tool is lifted, the core sample breaks just below the core catcher. The coring assembly is then pulled out of the hole to the surface to retrieve the core sample.

For unconsolidated formations, such as heavy oil sands, which present a risk of sliding out of the inner barrel during the travel to surface, a full closure type system (FCS) is deployed. An FCS system has a mechanism which seals the bottom of the inner barrel, for example by a collapsible shoe or mechanically activating the closure or sealing the bottom of the core, so that the captured core does not slip out of inner barrel. In a mechanical or collapsible shoe mechanism, once the inner tube is filled with core sample, the shoe collapses or seals blocking the bottom portion of the inner tube to prevent the core sample from sliding out of the inner tube. Such sealing mechanisms may replace the core catcher.

If an FCS or alternative system is used, a further steel ball which is dropped down the drill string has a second important function. Apart from acting as a one-way valve blocking flow of mud down the inner barrel, this second steel ball activates the FCS mechanism or alternative system to activate and seal the lower portion of the inner barrel preventing core from falling out of the core barrel.

Such standard coring methods provide no feedback to the operator. The operator has only an ambiguous indication of whether the core column is entering the inner barrel, inside the inner barrel, or has fallen out of the barrel. If the operator's judgement is incorrect, the coring operation can become extremely expensive and time consuming.

For example, if the operator considers that the core sample is in the inner barrel, when in fact the core sample has fallen out, the reality is only confirmed after the coring tool is retrieved to the surface.

Another example of incorrect functioning of the coring tool is 'core jamming'. The core formation can jam inside the inner barrel such that further core does not enter the inner barrel while the coring tool is working on the formation. If undetected, the core bit will merely mill the formation without obtaining full core.

Also, the coring equipment may get damaged because of core jamming. The time taken for retrieving the coring tool and a second round of coring is a few days on the rig.

As an estimate, the additional time spent due to the delay, in present day terms, amounts to millions of dollars of costs.

One or two drill operators have used expensive sensors in conjunction with a Mud Pulse Telemetry (MPT) system to provide feedback to the operator. Such sensors detect core capture and/or core fall out and provide a signal to a mud pulser which transmits the signal to the surface.

One such sensor is described in WO 2011020141 A1 published on 24 Feb. 2011. The contents of WO 2011020141 A1 are incorporated in their entirety in this patent application by reference.

The MPT system is a common method of data transmission used for Measuring While Drilling (MWD) tools. Down hole, a valve or a mud pulser" is operated to restrict the flow of the drilling mud according to the digital information to be transmitted. This creates pressure fluctuations representing the information. The pressure fluctuations propagate within the drilling fluid towards the surface where they are received from pressure sensors. On the surface, the received pressure signals are processed by computers to reconstruct the information.

The three types of MPT systems are positive pulse, negative pulse and continuous wave.

Positive MPT uses a hydraulic poppet valve to momentarily restrict the flow of mud through an orifice in the drill pipe to generate an increase in pressure in the form of positive pulse or pressure wave which travels back to the surface to be detected.

Negative MPT uses a controlled valve to vent mud momentarily from the interior of the drill pipe into the annulus between the drill pipe and the bore hole. This process generated a decrease in pressure in the form of a negative pulse or pressure wave which travels back to the surface to be detected.

Continuous wave telemetry uses a rotary valve or "mud siren" with a slotted rotor and stator which restricts the mud flow in such a way as to generate a modulating positive pressure wave which travels back to the surface to be detected.

There are other types of telemetry systems such as electro-magnetic (EM) system and induction system. An EM system applies voltage into the earth's crust, using it as a conductor. An EM system is cheaper than mud pulse system. However, an EM system is not suitable for use offshore where the EM signal does not pass through water. An induction system is suitable for use offshore. However, an induction system uses proprietary drill pipes having end connections to transmit signals from one drill pipe to another, and wired connection between two end connections of a drill pipe. These specialised drill pipes are expensive and in most operations they are cost prohibitive.

A standard MPT system is primarily designed for a drilling operation and not for coring operation. During drilling, the mud pulser is installed proximate to the drill bit.

Likewise, one or two operators (mentioned earlier) who have used sensors in conjunction with MPT have installed such mud pulser adjacent to the coring tool assembly. To do so, the sensors were placed in the coring assembly. An adjustable electrical coupling, connected to the sensors, protrudes out of the swivel assembly of the coring tool.

A plurality of flow subs that are designed specially for the mud pulser to operate are held above the coring tool having the sensors. These flow subs are different to regular drill pipes which form the drill string. The flow subs are made to suit the function of the mud pulser.

The electrical connection is made between the sensors and the mud pulser. The flow subs are lowered and screwed into the core assembly. Once assembled, the mud pulser is turned on via a download port provided on the periphery of one of the flow subs. Subsequently, the drill pipes are attached to the end of the mud pulser flow subs to form a drill string.

Once drilling fluid is pumped down the drill string, the pulser relays data from the sensors to the top of the drill string. The drilling fluid passes through the mud pulser to the coring tool.

There are many difficulties with this methodology.

Firstly, it is difficult to physically connect the adjustable electrical coupling of the sensor protruding from the coring assembly to the expandable electric coupling of the mud pulser.

It is very difficult to make the connection physically particularly on an off-shore rig because the platform of the off-shore rig is not steady. The person making the electrical connection has to place his hands between the core assembly and the heavy flow subs of the mud pulser suspended above the core assembly. This installation method increases the risk of accidents on the rig.

Secondly, the flow subs used with mud pulser are heavy and expensive because of their thickness and proprietary design. The proprietary flow subs are designed to be used with a mud pulser. They form a part of the Bottom Hole Assembly (BHA) and so they need to be thick in order to provide sufficient weight on the coring bit. This adds to the capital costs of the rig.

Thirdly, the flow subs of the mud pulser require a lot of critical maintenance. Particularly, their end threads need to be inspected after every job by a service company who provides the mud pulser. Such external inspections are expensive.

Further, the additional connections of flow subs required using existing method can increase the chance of tool failures. This adds to the cost of coring operation.

Also, time spent on-site on installing the MPT system and maintaining it adds to the cost of operating the drill rig.

Finally, an FCS system is not useable with such a system because it is not possible to drop a ball to the swivel assembly of a coring tool as the mud pulser blocks the passage of the ball.

So it is not possible to use the currently available FCS type systems in the aforementioned method.

SUMMARY OF THE INVENTION

It is desirable to provide a system for monitoring coring operations which:

is able to reliably signal coring parameters to the operator,
has reduced on-site assembly time and risk, and
can be used in conjunction with FCS type systems.

With the aforementioned problems in mind, in one aspect the present invention provides a system for monitoring coring operations including: a sensor for detecting one or more coring parameters in a down-the-hole coring assembly and producing an indicative signal, and a signal transmitter connected to the sensor for transmitting said indicative signal to the surface, wherein the signal transmitter is located in the coring assembly.

In the context of the present invention, a coring assembly is the equipment attached to a drill string for obtaining a core sample of the formation. In many instances, the coring assembly is the equipment that is attached to the drill string in place of a drilling tool.

By locating the signal transmitter in the coring assembly the entire system can be constructed or assembled off-site. On-site installation time is greatly reduced saving rig time.

Also, risks associated with on-site installation are also reduced. For example, there is no need to physically make an electrical connection between the coring assembly and the heavy signal transmitter assembly suspended from above.

Further, there is no need to use the heavy, expensive, and difficult to maintain flow subs which are normally associated particularly with Mud Pulse Telemetry (MPT).

The coring assembly may have an attachment end for attachment to a drill string.

The signal transmitter may be located below the attachment end in order to provide a passage for a ball dropped down a central annulus of the drill string to reach the coring assembly.

Preferably, the signal transmitter is located below a swivel assembly of the coring assembly.

Further preferably, a ball may be lowered/dropped down a central annulus of a drill string to the coring assembly in order to activate a Full Closure type Systems (FCS).

This location of the signal transmitter enables activation of an FCS system by means of dropping a ball. Thus allowing the signal transmitter to be used in conjunction with an FCS system which is necessary for capturing core sample from an unconsolidated formation.

The signal transmitter may be located above said sensor.

The signal transmitter may be co-axial with the coring assembly.

The signal transmitter may be a mud pulser electrically coupled to said sensor.

The coring assembly may have an inner barrel and an outer barrel, and the mud pulser may be located in the inner barrel.

Drilling fluid, after passing through the mud pulser, may be passed to an annulus between the inner barrel and the outer barrel through an opening in the inner barrel.

An electrical adaptor may be positioned in the inner barrel for activating the mud pulser, the adaptor being located below the mud pulser to block flow of drilling fluid down the inner barrel. Preferably, the adaptor is a download adaptor, which preferably provides an external port for electrical connection to download data from electronics.

The signal transmitter may be pre-installed in the coring assembly.

The sensor may detect and signal at least one of core entry, core capture, core jamming, and core fall out.

The sensor may include:

a core sample marker which rests, in use, on the top of a drilled core sample within the coring assembly, a cable connected at a first end thereof to the core sample marker, a cable tensioner located above the core sample marker to apply tension to the cable, and a cable movement detector, wherein as the drilled sample moves upwardly relative to the coring assembly, the cable tensioner draws the cable upwardly relative to the coring assembly and the cable movement detector determined the length of the cable drawn up, thereby providing information regarding the distance travelled by the core sample marker.

A further aspect of the present invention provides a coring assembly for attachment to a drill string, the coring assembly including a signal transmitter for transmitting a signal to the surface, the signal indicative of one or more down-the-hole coring parameters detected by at least one sensor connected to the signal transmitter.

The coring assembly may have an attachment end for attachment to the drill string, the signal transmitter being located below the attachment end.

The signal transmitter may be located below a swivel assembly of the coring assembly.

The signal transmitter may be located above said sensor.

The signal transmitter may be or includes a mud pulser.

A further aspect of the present invention provides a method of monitoring coring operations, including the steps of:

detecting one or more down-the-hole coring parameters by a sensor positioned down-the-hole, producing a signal indicative of the one more coring parameters, transmitting said indicative signal to the surface by means of a signal transmitter positioned in a coring assembly.

The coring assembly may have an attachment end for attachment to a drill string, the signal transmitter may be located below the attachment end, and the method may further include: dropping a ball down a central annulus of the drill string such that the ball reaches the coring assembly to activate a full closure system.

The signal transmitter may be or includes a mud pulser. The method may include: directing drilling fluid to pass through the mud pulser to an annulus between an inner barrel and an outer barrel of the coring assembly.

The method may include blocking the drilling fluid from flowing down the inner barrel by an adaptor located below the mud pulser.

The core sample progresses into the inner barrel as the drill advances into the ground. In some circumstances, it is possible for hydraulic lock or at least an unwanted pressure increase to occur above the core sample. This can happen, for example, if the material of the core sample is unconsolidated, sandy, soft, possibly oily or shale like, or swells, or is otherwise a tight fit within the inner barrel. This causes a seal around the core sample.

In a Full Closure Type System (FCS—as previously described), the steel ball (or other valve device) seals the inner barrel from the flow of drilling fluid/mud pumped down the central bore of the drillstring. This FCS system aims to prevent the core sample slipping back out of the inner barrel when the drillstring is removed from the bore.

However, with the steel ball creating a one way valve above the core sample, any fluid, such as ground water or drilling mud trapped on top of the core sample will start to be compressed as the core sample advances into the bore of the inner barrel.

Ordinarily the steel ball (or other valve provided) can lift to release such pressure above the core sample, allow the core sample to continue advancing into the inner barrel, and allow the excess fluid to escape.

However, if the pressure of drilling mud/fluid above the steel ball valve is greater than the excess pressure above the core sample and below the steel ball valve, hydraulic lock can occur.

Such hydraulic lock can prevent further advancement of the core sample into the inner barrel, resulting in an incomplete core sample, possibly a need to remove the drillstring to clear the problem, or a reduction in drilling fluid/mud pressure (which may affect drilling progress, increase drill bit wear or result in chippings not being carried to the surface or clogging at the drill bit or other at other parts of the down hole tools.

Consequently, there is a need for a device which helps to relieve or prevent such pressure build-up from above the core sample.

With this in mind, a further aspect of the present invention provides a core barrel pressure relief valve to relieve excess pressure from within a core barrel of a core sample drilling operation, the pressure relief valve opening when pressure within the core barrel exceeds pressure between inner and outer barrels of the drilling operation.

Preferably the core barrel pressure relief valve is provided in a relief valve adapter for positioning in an inner barrel housing of a drill string between a signal transmitter, such as a mud pulse unit, and a core limit recording/recognition system.

More preferably, the core barrel pressure relief valve includes at least one outlet port exiting to an annulus between the inner and outer barrels of the drilling operation.

The relief valve adapter may include electrical connection to electronics of the core limit recording/recognition system. The electrical connection may include connection to a mud pulse unit, such as for transmitting via the mud pulse unit signals relating to the successful entry of the core sample into the inner core barrel.

The pressure relief valve may act as a one way or check valve, preventing drilling fluid/mud entering into the inner core barrel. Such a valve may include a ball valve having a ball and valve seat.

Another aspect of the present invention provides an adapter for use with an inner barrel assembly of a core sample drilling operation, the adapter including a pressure relief valve to release excess pressure from within an inner core barrel that receives a core sample.

The adapter may be provided between in an inner barrel housing of a drill string between a mud pulse unit and the core sample.

BRIEF DESCRIPTION OF THE DRAWINGS

The present disclosure is best understood from the following detailed description of the preferred embodiment when read with the accompanying figure. It is emphasized that, in accordance with the standard practice in the industry, various features are not drawn to scale. In fact, the dimensions of the various features may be arbitrarily increased or reduced for clarity of discussion.

DESCRIPTION OF PREFERRED EMBODIMENT

Figure 1:
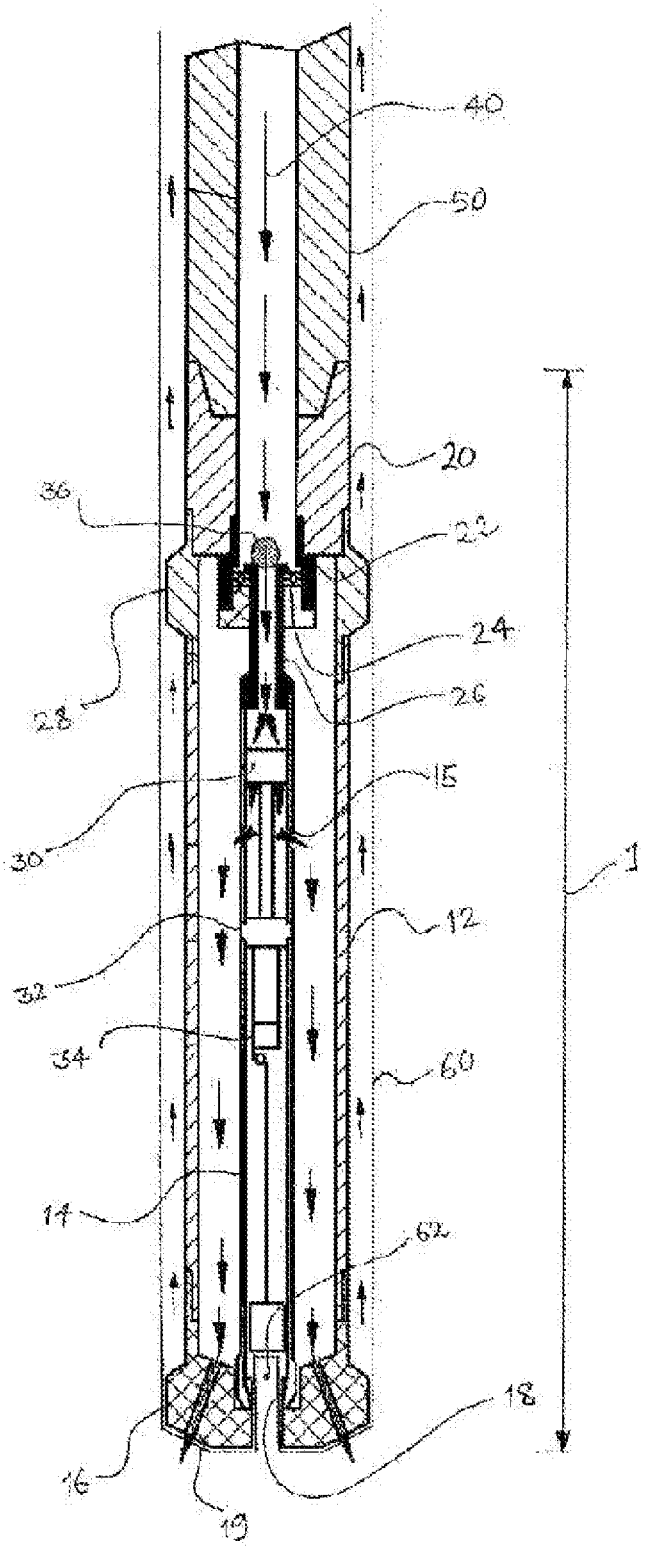
FIG. 1 illustrates a sectional view of a system for monitoring coring operations according to one embodiment of the present invention.

Referring to FIG. 1, the coring assembly 10 includes an annular coring bit 16 attached to an outer barrel 12, the outer barrel 12 connected to the OD of a top sub 20 through a stabiliser 28, and an inner barrel 14 positioned inside the outer barrel 12, the inner barrel 14 connected to the ID of the top sub 20 through a swivel assembly 22. The coring assembly 10 is connected to the end drill pipe 50 of a drill string by means of a threading engagement between the top sub 20 and the drill pipe 50.

As the drill pipe 50 is rotated, torque is transmitted to the coring bit 16 through the top sub 20, the stabiliser 28 and the outer barrel 12. The swivel assembly 22 has a radial bearing 24. The OD of the bearing 24 is connected to the top sub 20. The ID of the bearing 24 is connected to the inner barrel 14 through a center pipe 26 of the swivel assembly 22. The inner barrel 14 is thus restricted from rotating when torque is transmitted through the drill pipe 50.

The torque and thrust on coring bit 16 causes the coring assembly 10 to penetrate the formation. As the coring assembly 10 advances in the formation, a core sample 62 slightly smaller than the ID of the annular coring bit 16 enters the inner barrel 14.

The inner barrel 14 is provided with a core catcher 18 which may be spring loaded. Once the inner barrel 14 is filled with core sample 62, rotation of the core bit 16 is stopped and the drill string is lifted. The core catcher 18 helps break the core sample 62 from the formation upon lifting of the coring assembly 10.

A sensor 34 for measuring coring parameters in a down-the-hole coring assembly and producing an indicative signal is provided in the inner barrel 14. As referenced earlier, the sensor 34 is as described in WO 2011020141 A1. Of course, other type of sensor may be used instead. The sensor 34 detects and signals at least one of core entry, core capture, core jamming, and core fall out.

A signal transmitter, particularly a mud pulser 30, for transmitting signals from the sensor 34 to the surface, is provided in the coring assembly 10. Particularly, the mud pulser 30 is located in the inner barrel 14. The mud pulser 30 is positioned above the sensor 34 and below the swivel assembly 22. The mud pulser is co-axial with the coring assembly 10, in particular with the inner barrel 14.

The mud pulser 30 used as per standard Mud Pulse Telemetry (MPT) systems. Coded pressure spikes caused by opening and closing of mud pulser valve travel through the drill string to surface.

At the surface i.e. at the top of the drill string, the pulse signals are decoded into useful information which helps determine whether the core sample 62 is entering the inner barrel 14, inside the inner barrel 14 or fallen out of the inner barrel 14. The information received is as per the information sent by the sensor 34.

Drilling fluid of 'mud' is pumped down the drill string 50 such that it passes through the top sub 20, enters the center pipe 26 of the swivel assembly 22, then into the inner barrel 14, through the mud pulser 30, then out of an opening 15 in the inner barrel into the annulus between the inner barrel 14 and the outer barrel 12, and then out of the ports 19 in the core bit 16. The drilling mud along with drill cuttings is returned to the surface from the annulus between the drill string 50 and the borehole wall 60. The direction of the drilling mud is indicated by the arrows having reference numeral 40.

If the present system is to be retro-fitted in an existing coring assembly 10, the openings in the coring assembly 10 situated above the mud pulser must be closed off in order to prevent unnecessary pressure drop in the drilling mud and incorrect mud pulse signalling. There may be such openings, for example, in the center pipe 26 and swivel bearing 24 which need to be sealed off. The fluid column above the mud pulser 30 needs to be 'solid'. Also, an opening below the mud pulser 30, in the inner barrel 14, will need to be made for retro-fitting.

The mud pulser 30 is electrically connected to the sensor 34 through an adaptor 32. The adaptor 32 is positioned between the sensor 34 and the mud pulser 30, and below the opening 15. The adaptor 32 prevents the drilling muds from being passed down the inner barrel 14, thereby protecting the sensor 34 and also creating space for the core sample 62 to be received in the inner barrel 14. The adaptor 32 has an electrical port on its outer periphery which can be accessed from outside the inner barrel 14. The electrical port is used for activating the mud pulser 30 and also for downloading the sensor data for verification after the coring assembly 10 is returned to the surface.

In an alternative embodiment, if the formation is likely to be unconsolidated for example sandy, instead of a core catcher 18 a Full Closure Type System (FCS) may be provided. As explained in the background section, a FCS system has mechanism which seals above the inner barrel 14, after core is fully within the inner barrel 14, so that the captured core does not slip out of inner barrel 14. The FCS system is activated by dropping a ball 36 down the drill pipe 50 such that the ball 36 either rests on the top portion of the swivel assembly 22 or in the center pipe 26. Once the ball 36 is in the swivel assembly 22, the flow of drilling muds is restricted.

Pressure created by the drilling muds in the drill string forces the inner barrel 14 to slide downwards. The downward movement of the inner barrel 14 activates the FCS system.

One way of activating the FCS system is to shear a pin to seal the lower portion of the inner barrel 14.

By locating the mud pulser 30 below the swivel assembly 22, there is a passage available for the ball 36 to be dropped down the drill pipe 50 such that it reaches the swivel assembly 22. This enables the use of MPT with an FCS system.

In a further alternative embodiment, the mud pulser 30 is a negative or continuous wave mud pulser.

In a further alternative embodiment, the signal transmitter is a device other than a mud pulser, for example an electromagnetic telemetry system, an active or passive acoustics transmission system, or a fluid vortex system.

In a further alternative embodiment, the signal transmitter in the coring assembly is connected to other sensors, the information of which would be useful to the operator in real time (rather than recorded and obtained after retrieving the drill string to the surface). Examples of such sensors are gamma ray, resistivity sensors which provide information relating to the formation such as whether the formation is filled with oil or water, etc.

The present invention applicable to FCS type systems including mechanical and collapsible shoe FCS.

The present application is applicable to axial coring as well as side wall coring.

One or more stabilisers, e.g. stabilisers 70, 72 can be provided on the external surface of the outer barrel 12. Stabilisers can include wear resistant material, such as tungsten carbide e.g. in the form of tungsten carbide inserts in a steel body of the stabiliser. The stabiliser acts to maintain the drill bit centralised within the bore and acts to prevent lateral vibration/movement of the drill bit during drilling/coring, which helps to prevent premature breakage of the core from the rock.

Figure 2:
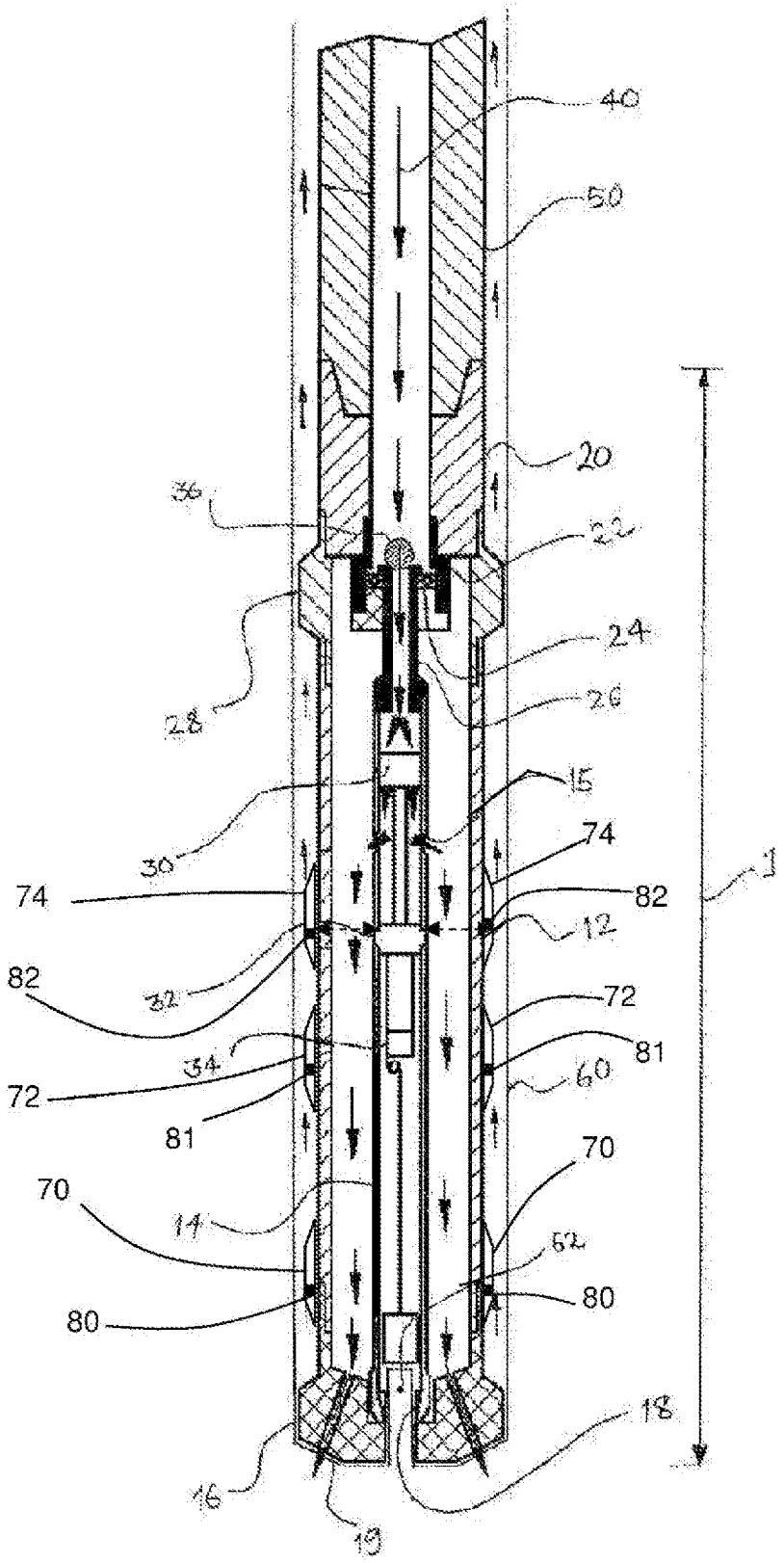
FIG. 2 illustrates a sectional view of a system for monitoring coring operations according to a further embodiment of the present invention.

As shown in FIG. 2, the lowermost stabiliser 70 is provided immediately above the drill bit. According to one or more embodiments of the present invention, a stabiliser, preferably the lowermost stabiliser, can be instrumented with at least one in-stabiliser sensor 80.

Preferably the at least one in-stabiliser sensor can include one or more sensors 80 (aka 'at bit sensors' due to their relative proximity to the drill bit), such as logging-while-drilling (LWD) sensors, one or more vibration sensors, one or more temperature sensors, one or more pressure sensors, one or more radiation sensors (such as gamma radiation sensing), one or more weight-on-bit (WOB) sensors, one or more torque and/or rpm sensors, one or more gravity and/or magnetic field sensors, or any combination of two or more of such sensors.

By wireless, wired or induction communication, the signal(s) relating to downhole parameters sensed by the in-stabiliser sensor(s) can be transferred a distance uphole to a signal transmitter 30 (e.g. mud pulse system).

One or more additional (intermediate) stabilisers 72 between the lowermost stabiliser 70 adjacent the drill bit can be used to 'hop' (communicate) the sensed signal(s) relating to the sensed parameters to the signal transmitter.

Therefore, additional communication means can be provided within the intermediate stabiliser(s). The additional or intermediate stabiliser can be included as part of a short hop sub.

Power for such communication can be provided by energy harvesting during drilling operations, such as from vibration and/or rotation, or by battery or by wired connection to a power supply.

Preferably, signal(s) from the lowermost stabiliser 70 is/are received by an interface 74 which communicates to the signal transmitter/CLRS (core limit registration/recognition system).

The interface 74 can include one or more further stabilisers. Communication between the interface and the signal transmitter can be by way of induction or sliding contact electrical conduction to cross the gap between the outer barrel 12 and the electronics in the signal transmitter/CLRS system within the inner barrel 14.

Thus, a system of one or more embodiments of the present invention can include an induction communication means 82 acting between the outer barrel and the signal transmitter/CLRS within the inner barrel. The signal transmitter, such as a mud pulser, then relays the sensed parameters to the surface, along with any measurement while drilling (MWD) data.

Figure 3:
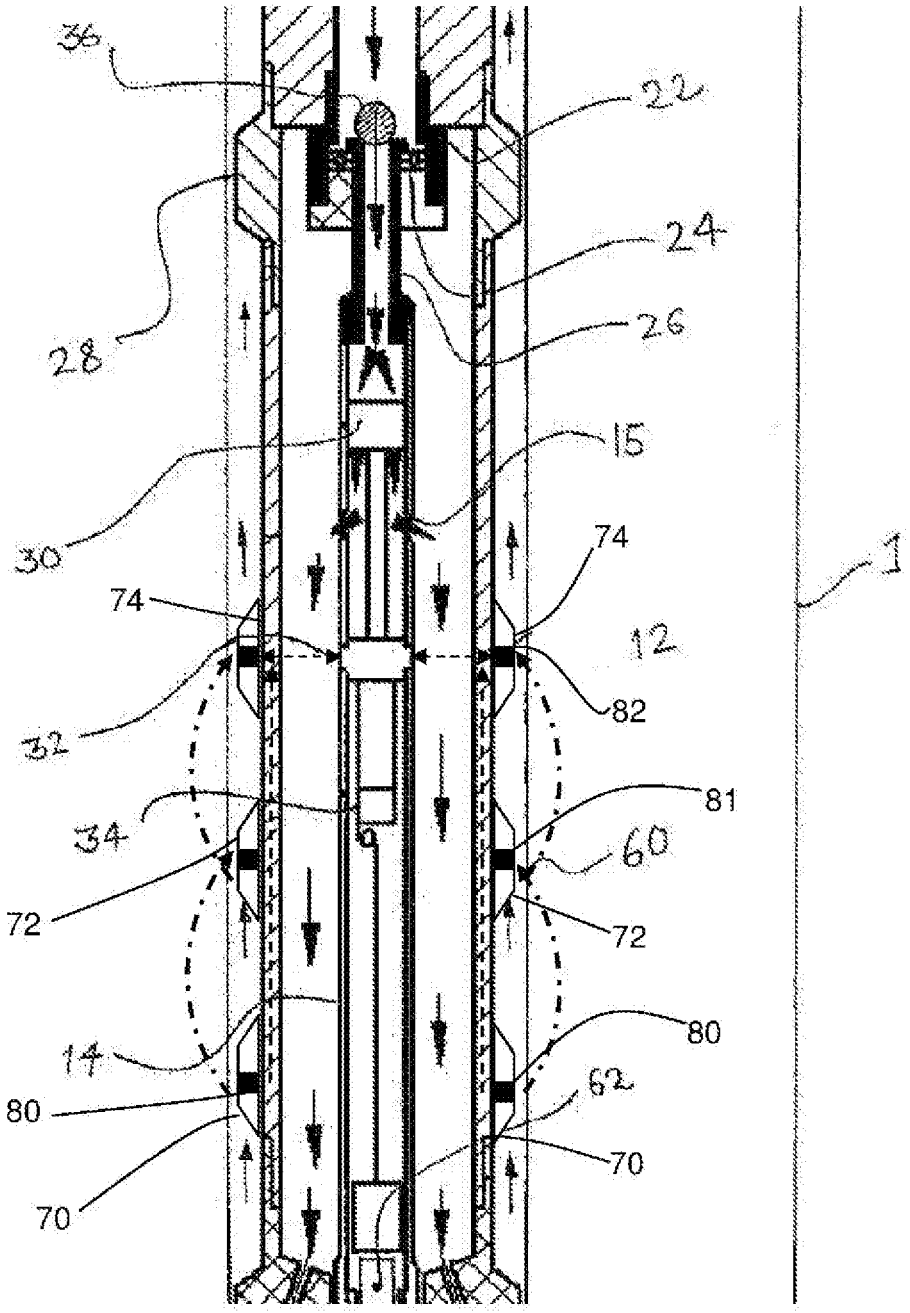
FIG. 3 illustrates an embodiment of the present invention highlighting near drill bit stabilisation, sensing and signal communication to electronics further up the barrel.

FIG. 3 highlights the near bit stabiliser(s) 70 provided on the outer barrel. Optional intermediate stabiliser(s) 72 may be provided between the near bit stabiliser(s) and one or more stabiliser(s) 74 adjacent the electronics relating to the CLRS/mud pulse unit.

Each of the stabilisers 70, 72, 74 can include at least one sensor sensor and/or signal relay function 80, 81, 82. For example, the sensor(s) 80 at the near bit stabiliser 70 may be embedded in or mounted on the respective stabiliser.

Signals from the near bit sensor(s) 80 relating to downhole parameters/measurements can be communicated to a receiver further up the barrel at the next or further stabiliser 72, 74. Such signal communication can be wireless, as represented by the curved dashed arrows between stabiliser sensor/communicators 80, 81, 82, or can be through the material of the outer barrel, such as by electrical conduction, represented by the straight dashed arrows within the cross section side wall of the outer barrel in FIG. 3.

Signals from the sensor/communicator 82 adjacent the CLRS/mud pulser can be communicated to the electronics relating to the CLRS/mud pulser by induction across the gap between the inner and outer barrels. Alternatively, a physical electrically conductive connection can be provided across that gap. For example, by a sliding rotary electrical contact maintaining electrical connection as the outer barrel rotates with the drill bit and the inner barrel remains generally non-rotating.

Figure 4:
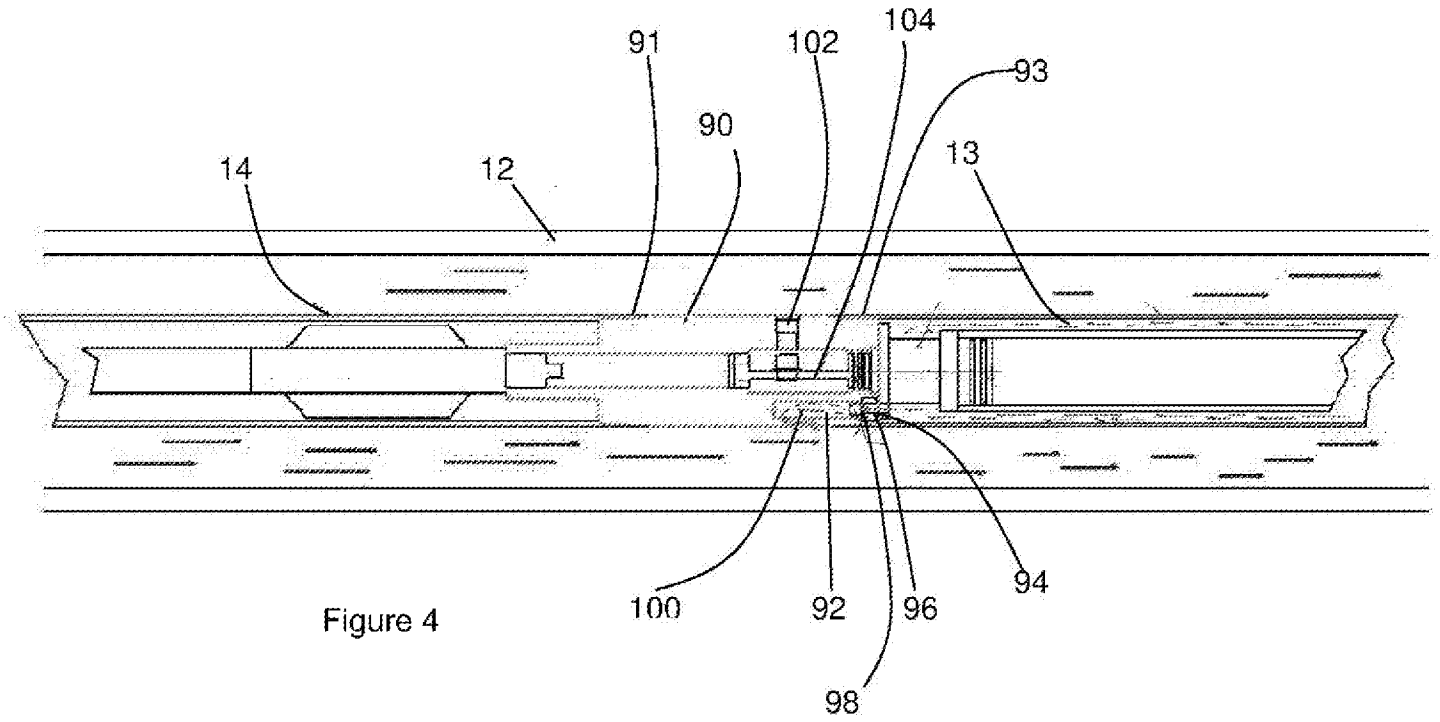
FIG. 4 illustrates a further embodiment of the present invention providing a check valve arrangement allowing pressure relief/flow control.
Figure 5:
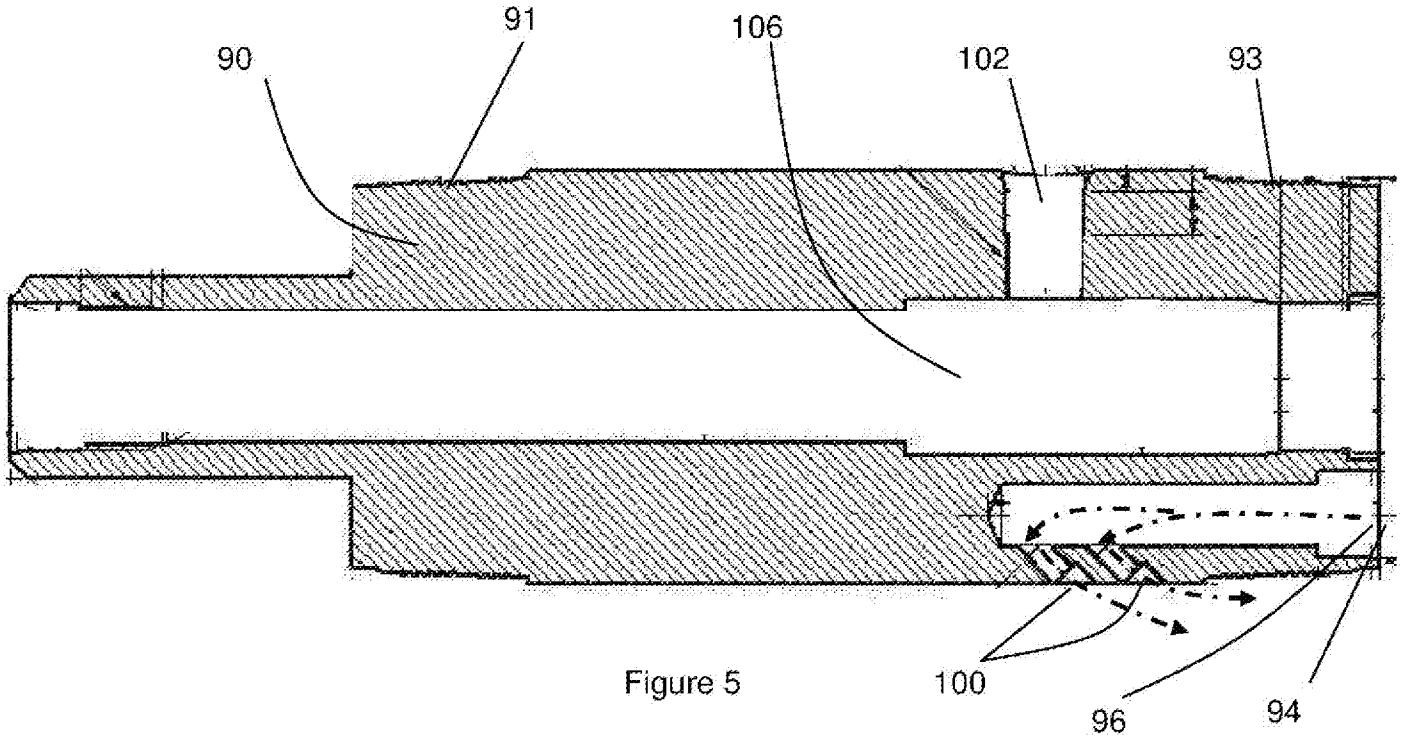
FIG. 5 shows a cross section an example of an adapter with check valve porting according to an embodiment of the present invention

As shown by way of example in FIG. 4 and in detail in FIG. 5 (though the ball of the check valve is omitted din FIG. 5), a further form of the present invention provides at least one check valve/one way valve 92 allowing pressure relief/fluid flow one way from the annulus between the core limit registration/recognition system and the inside facing wall of the inner barrel 14.

The check valve(s)/one way valve(s) 92 can be provided as part of a download/check valve adapter/sub 90 mounted between the signal transmitter (such as a mud pulser) and the core limit recognition/registration system (CLRS).

The adapter/sub 90 can include a first threaded connection 91 to connect to the drillstring or mud pulser, and a second threaded connection 93 for connection to the core barrel.

The one way valve/check valve 92 can include an inlet 94 from the inner core barrel, a valve seat 96, a ball 98 to seat against the valve seat when pressure in the annulus exceeds pressure in the inner core barrel and to lift when pressure in the inner core barrel exceeds pressure in the annulus.

One or more ports 100 lead from the one-way valve/check valve 92 to the annulus. Therefore, excess pressure and therefore drilling fluid/mud from above the core sample within the inner core barrel can be fed back into the flow of drilling fluid/mud in the annulus flowing to the drill bit (and which is returned to the surface with chippings via the space between the outer barrel and the bore. Dashed arrows shown in FIG. 5 represent flow of such excess fluid from the ports 100 of the check valve 92.

Data can be communicated to/from the CLRS electronics and sensor(s) via a download port 102 connected to the wiring harness/electrical connections 104 within a space 106 in the adapter/sub 90.

REFERENCE NUMBER TABLE

| No. | Feature |
|---|---|
| 10 | Coring Assembly |
| 12 | Outer Barrel |
| 13 | Annulus between CLRS and inner barrel |
| 14 | Inner Barrel |
| 15 | Opening |
| 16 | Coring bit |
| 18 | Core catcher |
| 19 | Port |
| 20 | Core assembly top sub |
| 22 | Swivel assembly |
| 24 | Swivel bearing |

-continued

REFERENCE NUMBER TABLE

| No. | Feature |
|---|---|
| 26 | Center pipe of the swivel assembly |
| 28 | Stabiliser |
| 30 | Signal transmitter/Mud pulser |
| 32 | Adaptor |
| 34 | Sensor |
| 36 | Illustrative location of steel ball |
| 40 | Direction of drilling fluids |
| 50 | Drill pipe/Drill string |
| 60 | Bore hole wall |
| 62 | Core sample |
| 70 | Lowermost stabiliser |
| 72 | Additional/Intermediate stabiliser |
| 74 | upper stabiliser |
| 80 | Stabiliser sensor(s) |
| 81 | Stabiliser sensor/relay |
| 82 | Interface/communication means |
| 90 | Download/check valve adapter/sub |
| 91 | Threaded connection to drillstring |
| 92 | Check valve |
| 93 | Threaded connection to core barrel |
| 94 | Valve inlet/opening |
| 96 | Valve seat |
| 98 | Valve ball |
| 100 | Valve outlet port(s) |
| 102 | Download port |
| 104 | Wiring harness/electrical connections |
| 106 | Space within the adapter for the wiring harness/electrical connections |

What is claimed is:

1. A system for monitoring coring operations comprising:

a sensor provided within a coring assembly, the coring assembly comprising an inner barrel and an outer barrel and the sensor being provided for detecting one or more coring parameters relating to the coring assembly and producing an indicative signal; and a signal transmitter connected to the sensor for transmitting said indicative signal to the surface, the signal transmitter comprising a mud pulser electrically coupled to said sensor;

wherein the signal transmitter is located below an attachment end for attachment to a drill string in order to provide passage for a ball that is dropped down a drill pipe of the drill string and below a swivel assembly of the coring assembly such that drilling fluid, after passing through the mud pulser, is passed to an annulus between the inner barrel and the outer barrel through an opening in the inner barrel below the mud pulser.

2. The system in accordance with claim 1, wherein the ball is dropped down a central annulus of the drill string to the coring assembly in order to activate a sealing mechanism which seals a bottom of the inner barrel.

3. The system in accordance with claim 1, wherein the signal transmitter is located above said sensor.

4. The system in accordance with claim 1, wherein the signal transmitter is co-axial with the coring assembly.

5. The system in accordance with claim 1, including an electrical adaptor positioned in the inner barrel for activating the mud pulser, the adaptor being located below the mud pulser to block flow of drilling fluid down the inner barrel.

6. The system in accordance with claim 5, wherein the adaptor is an external port for electrical connection to download data from electronics.

7. The system in accordance with claim 1, wherein said sensor detects and signals at least one of core entry, core capture, core jamming, and core fall out.

8. The system in accordance with claim 1, wherein the sensor comprises:

a core sample marker which rests, in use, on the top of a drilled core sample within the coring assembly;

a cable connected at a first end thereof to the core sample marker;

a cable tensioner located above the core sample marker to apply tension to the cable; and a cable movement detector, wherein as the drilled core sample moves upwardly relative to the coring assembly, the cable tensioner draws the cable upwardly relative to the coring assembly and the cable movement detector determines the length of the cable drawn up, thereby providing information regarding the distance travelled by the core sample marker.

9. A coring assembly for attachment to a drill string, the coring assembly comprising:

a signal transmitter for transmitting a signal to the surface, the signal indicative of one or more down-the-hole coring parameters detected by at least one sensor connected to the signal transmitter, wherein the signal transmitter is a mud pulser; and an inner barrel and an outer barrel, wherein drilling fluid, after passing through the mud pulser, is passed to an annulus between the inner barrel and the outer barrel.

10. The coring assembly in accordance with claim 9, wherein the coring assembly has an attachment end for attachment to the drill string, the signal transmitter being located below the attachment end.

11. The coring assembly in accordance with claim 10, wherein the signal transmitter is located below a swivel assembly of the coring assembly.

12. The coring assembly in accordance with claim 9, wherein the signal transmitter is located above said sensor.

13. The coring assembly in accordance with claim 9, wherein the signal transmitter is or includes a mud pulser.

14. A method of monitoring coring operations, comprising acts of:

detecting one or more down-the-hole coring parameters by a sensor positioned down-the-hole;

producing a signal indicative of the one more coring parameters; and transmitting said indicative signal to the surface by means of a signal transmitter positioned in a coring assembly, wherein the signal transmitter is a mud pulser, and wherein the method further comprises an act of directing drilling fluid to pass through the mud pulser to an annulus between an inner barrel and an outer barrel of the coring assembly.

15. The method in accordance with claim 14, wherein the coring assembly has an attachment end for attachment to a drill string, the signal transmitter being located below the attachment end, wherein the method further comprises an act of dropping a ball down a central annulus of the drill string such that the ball reaches the coring assembly to activate a sealing mechanism which seals a bottom of the inner barrel.

16. The method in accordance with claim 14, wherein the method further comprises an act of blocking the drilling fluid from flowing down the inner barrel by an adaptor located below the mud pulser.

* * * * *